US010351367B2

(12) United States Patent
Barmaki et al.

(10) Patent No.: US 10,351,367 B2
(45) Date of Patent: Jul. 16, 2019

(54) MEDIA TRAY ASSEMBLY

(71) Applicant: Hewlett-Packard Development Company, L.P., Houston, TX (US)

(72) Inventors: Layce Barmaki, San Diego, CA (US); Randall West, Vancouver, WA (US); Jesse Phillips, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/758,905

(22) PCT Filed: Sep. 30, 2015

(86) PCT No.: PCT/US2015/053373
§ 371 (c)(1),
(2) Date: Mar. 9, 2018

(87) PCT Pub. No.: WO2017/058227
PCT Pub. Date: Apr. 6, 2017

(65) Prior Publication Data

US 2018/0305144 A1 Oct. 25, 2018

(51) Int. Cl.

| | |
|---|---|
| ***B65H 1/26*** | (2006.01) |
| ***B65H 1/04*** | (2006.01) |
| ***B65H 3/44*** | (2006.01) |

(52) U.S. Cl.
CPC ..... *B65H 1/04* (2013.01); *B65H 1/266* (2013.01); *B65H 3/44* (2013.01); *B65H 2402/54* (2013.01); *B65H 2403/53* (2013.01); *B65H 2405/1144* (2013.01); *B65H 2405/12* (2013.01); *B65H 2405/332* (2013.01); *B65H 2511/11* (2013.01); *B65H 2511/12* (2013.01); *B65H 2511/15* (2013.01)

(58) Field of Classification Search
CPC ..... B65H 1/04; B65H 1/266; B65H 2511/10; B65H 2511/11; B65H 2511/12; B65H 2405/332; B65H 3/44; B65H 2405/1144
See application file for complete search history.

(56) References Cited

U.S. PATENT DOCUMENTS

| | | | | |
|---|---|---|---|---|
| 3,539,178 A | | 11/1970 | Yanagawa | |
| 5,005,820 A | | 4/1991 | Leemhuis | |
| 5,292,117 A | * | 3/1994 | Takagi | B41J 11/58 271/127 |

(Continued)

FOREIGN PATENT DOCUMENTS

| | | |
|---|---|---|
| CN | 1636849 A | 7/2005 |
| CN | 101266424 A | 9/2008 |

(Continued)

OTHER PUBLICATIONS

Rso Kagaku Corp. Multi-Tray Paper Feed Section, Chapter 5. Rev 0.2 ~ 28 pages Jan. 2006.

*Primary Examiner* — Luis A Gonzalez
(74) *Attorney, Agent, or Firm* — Nathan Rieth

(57) ABSTRACT

In an example implementation, a media tray assembly for use in an imaging device includes a media width adjuster having a bottom portion and a top portion. The top portion of the media width adjuster is extendable between a first stable position and a second stable position. The media tray assembly also includes a tension spring to drive the top portion to the stable positions.

12 Claims, 5 Drawing Sheets

(56) References Cited

U.S. PATENT DOCUMENTS

| | | | | | |
|---|---|---|---|---|---|
| 5,794,928 | A * | 8/1998 | Araseki | B65H 1/04 271/126 |
| 5,934,667 | A | 8/1999 | Miki | |
| 6,106,178 | A | 8/2000 | Chiu | |
| 7,290,952 | B2 | 11/2007 | Kagami | |
| 7,398,969 | B2 | 7/2008 | Elenes et al. | |
| 8,170,462 | B2 | 5/2012 | Park | |
| 8,387,968 | B2 * | 3/2013 | Fujikura | B65H 1/14 271/157 |
| 8,528,892 | B2 * | 9/2013 | Nakamura | B65H 1/266 271/171 |
| 8,899,569 | B2 * | 12/2014 | Soga | B65H 39/00 270/58.07 |
| 2003/0075858 | A1 | 4/2003 | Vedoy | |
| 2004/0131412 | A1 | 7/2004 | Bingham et al. | |
| 2005/0258586 | A1 | 11/2005 | Elenes et al. | |
| 2014/0319761 | A1 | 10/2014 | Komuro | |

FOREIGN PATENT DOCUMENTS

| | | | | |
|---|---|---|---|---|
| CN | 201473071 | U | | 5/2010 |
| CN | 201567092 | U | | 9/2010 |
| CN | 104708911 | A | | 6/2015 |
| EP | 1559670 | | | 8/2005 |
| JP | 09263335 | A | * | 10/1997 |
| JP | 2004010316 | A | * | 1/2004 |
| JP | 2005059980 | A | * | 3/2005 |

* cited by examiner

MEDIA TRAY ASSEMBLY

BACKGROUND

Some printing devices provide the convenience of having different types of printable media that can be automatically selected based on a desired printed output. Such printers can have a media input tray system that includes multiple media trays to accommodate the different types and sizes of media. For example, a printer can have a main media tray to be loaded with plain paper, as well as a photo tray to be loaded with photo paper. The printer can then automatically engage either media tray in order to access the appropriate type of media depending on whether a user is printing a plain paper document or a photographs.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
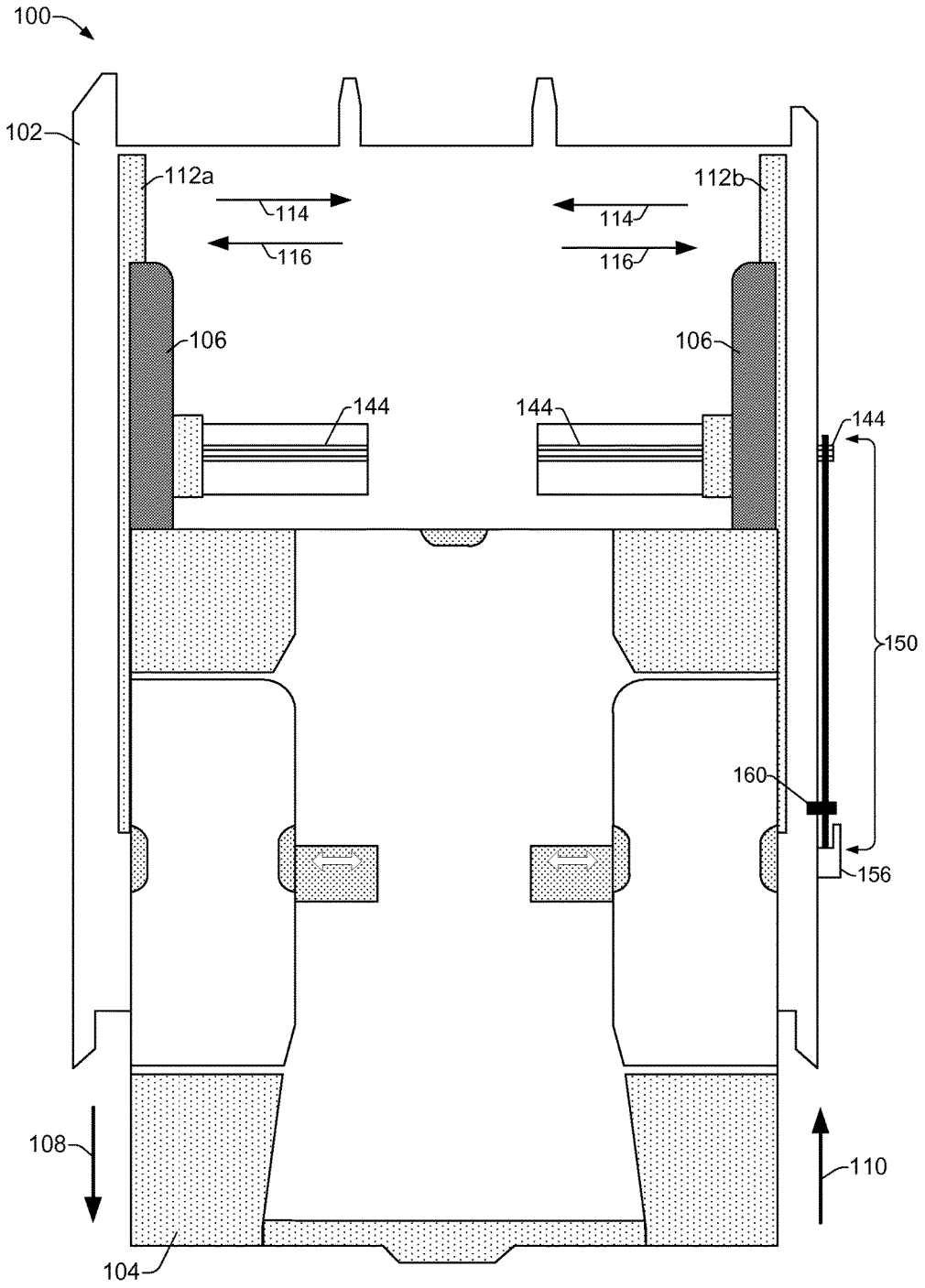
FIG. 1 shows a top down view of an example media tray assembly that includes a first media tray and a second media tray.

Printer manufacturers offer a wide variety of printing and/or imaging devices that bring a range of features to consumers. For example, many multifunction printers (MFPs), or all-in-ones (AIOs), can print, copy, scan and fax. Another feature often desired by consumers is a high quality photo print feature. However, generating high quality photo prints is generally not possible when printing on plain paper. The use of plain paper for printing high quality photo images is impractical due to bleed-through of ink and/or other printing fluid, as well as other poor results related to the light weight and high porosity of the paper. By contrast, photo paper is coated in a way that reduces porosity and adds stability, resulting in less bleed-through and more surface ink that enables higher quality photo prints.

Accordingly, printers that produce high quality photo prints can utilize both plain paper to produce plain paper documents, as well as photo paper to produce high quality photo prints. In addition, to facilitate a convenient printing process that transitions seamlessly between printing plain paper documents and high quality photo prints, such printers often include a media tray assembly that comprises two different media trays that are automatically accessible by the printer. The appropriate paper can be automatically picked by the printer based on print selections from the user. This type of media tray assembly relieves the user of having to feed photo paper into the printer or having to swap plain paper with photo paper using a single media tray when printing photos.

In some examples, a media tray assembly for an imaging device such as a printer includes a main media tray for the plain paper and a photo tray for the photo paper. Both the main paper tray and the photo paper tray can have media width adjusters that enable differently sized paper to be used. The media width adjusters can be manually adjusted to align the paper within the tray so that pages of paper can be properly picked up and consumed by the printer. Some media tray assemblies are designed so that the photo tray fits on top of and/or within the main paper tray. This nested arrangement of the two media trays reduces the amount of space taken up by both trays and enables a more efficient paper pick by the printer from the main paper tray and the photo paper tray.

While the ability to select between plain paper and photo paper from two different paper trays for a given print job is convenient for the user, in some circumstances a nested arrangement of the two media trays can be an inefficient use of space. As noted above, in some media tray assembly systems the photo tray fits on top of or within the main plain paper tray. Thus, the photo tray takes up room within the main paper tray that might otherwise be used to hold an additional amount of plain paper. In some circumstances, such as when a user is printing large numbers of plain paper documents and no photo prints, increasing the amount of plain paper held within the main paper tray can provide a significant benefit. However, simply removing the photo tray to provide more room for plain paper in the main paper tray is not feasible. This is because the height of the walls of the media width adjusters in the main tray is limited to the point where the bottom of the photo tray rests within the main paper tray. Therefore, removing the photo tray and stacking additional plain paper into the main paper tray can cause paper toward the top of the plain paper stack to be higher than the walls of the media width adjusters. Paper stacked higher than the height of the walls of the media width adjusters will not be properly aligned when the user manually adjusts the media width adjusters. Because printers generally pick paper from the top of the media stack, the misaligned pages will likely cause a paper jam or other problem when picked by the printer.

Accordingly, examples of a media tray assembly for use in a printing/imaging system as described herein offer a versatile dual tray solution that enables increasing the amount of media (e.g., plain paper) available from a first media tray while maintaining proper media alignment for the printer. The example media tray assembly also maintains the benefit of having dual nested media trays from which the printer can automatically access first media such as plain paper from within the first media tray or second media such as photo paper from a second media tray. It is noted that while examples herein are discussed with respect to the use of plain paper media in a first media tray and photo paper media in a second tray, other types of media without limitation are possible and contemplated for use within the first media tray and the second media tray. In this regard, the second media tray might also be referred to as a specialty media tray. Examples of various types of printable media that may be suitable for use in the first media tray and the second media tray include plain paper, photo paper, card stock, transparencies, Mylar, polyester, fabric, canvas, plywood, foam board, and so on.

Examples of a media tray assembly include a first media tray for first media such as plain paper and a second media tray (or specialty tray) for second media such as photo paper. In a dual use scenario, the second media tray sits in a nested position within the first media tray, and the printer can access media from either tray. In a single use scenario, the second media tray is removed from the first media tray and the printer can access an increased amount of media from the first media tray. The first media tray includes media width adjusters with walls that push paper into alignment as a user positions the adjusters. The media width adjusters have a bottom portion and a top portion that are movable horizontally (i.e., from left to right) to accommodate different widths of paper. The top portion of the media width adjusters is also movable in a vertical direction to increase the height of the walls when the second media tray is removed from the first media tray. The heightened walls of the media width adjusters allow additional amounts of media such as plain paper to be added into the first media tray when the second media tray is removed.

The top portion of each media width adjuster is drivable between first and second stable positions by a tension spring and a uniform motion mechanism that elevates and lowers the top portion evenly between the stable positions. As the second media tray is removed from the first media tray, a pin engages and translates a linkage assembly. Translation of the linkage assembly rotates a shaft with a cam that engages and activates the uniform motion mechanism.

In one example, a media tray assembly for use in an imaging device includes a media width adjuster having a bottom portion and a top portion. The top portion of the media width adjuster is extendable between a first stable position and a second stable position. The media tray assembly also includes a tension spring to drive the top portion to the stable positions.

In another example, a media tray assembly includes a first media tray having two media width adjusters with walls to align media. The media tray assembly also includes a second media tray positioned within the first media tray. A wall heightening mechanism is used to increase the height of the walls upon removal of the second media tray from the first media tray.

In another example, a media tray assembly includes a first media tray, and a second media tray insertable into and removable from the first media tray. The media tray assembly also includes media width adjusters to align media within the first media tray. The media width adjusters comprise height-extendable walls that extend upon removal of the second media tray from the first media tray.

Figure 2:
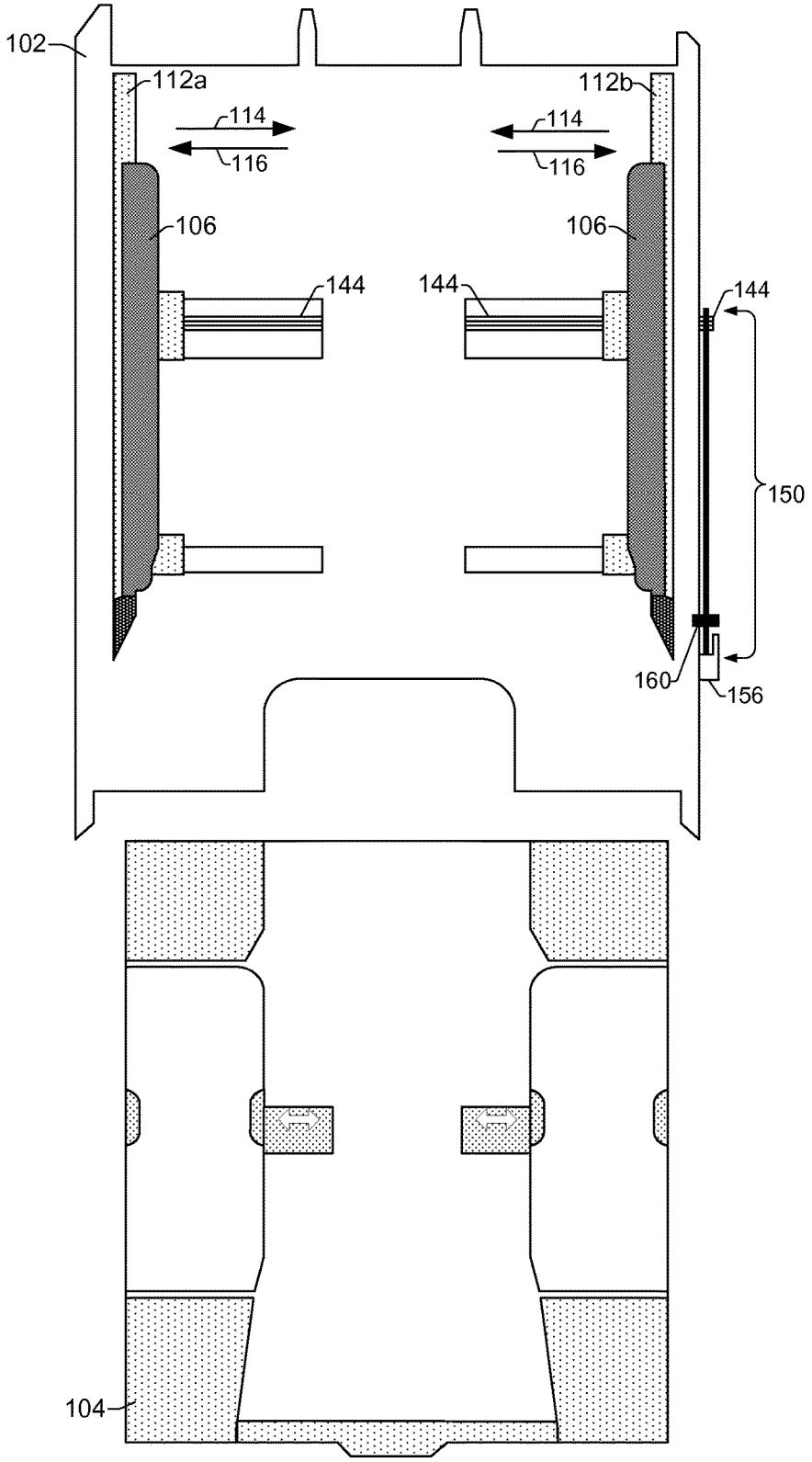
FIG. 2 shows a top down view of the example media tray assembly with the first media tray and the second media tray separated from one another.

FIG. 1 shows a top down view of an example media tray assembly 100 that includes a first media tray 102 and a second media tray 104. FIG. 2 shows a top down view of the example media tray assembly of FIG. 1 with the first media tray 102 and the second media tray 104 separated from one another. As shown in FIG. 1, the second media tray 104 is in a position of being partially inserted or partially removed from the first media tray 102. The second media tray 104 can be slidably inserted and removed from the first media tray 102 on rails 106. Thus, the second media tray 104 can be removed by a user pulling the second media tray 104 out in a direction 108 from the first media tray 102 on rails 106, and it can be inserted by a user pushing the second media tray 104 in a direction 110 into the first media tray 102 on rails 106.

The first media tray 102 has left and right media width adjusters 112*a* and 112*b*, respectively, that can be manually repositioned from left to right in order to align paper within the tray 102. The view of the media width adjusters 112 is mostly obstructed by the partially inserted second media tray 104 in FIG. 1. However, as can be seen in FIG. 2, the length of the media width adjusters 112 extends along most of the length of the first media tray 102. Movement of the left and right media width adjusters 112 is mirrored, such that when either the left 112*a* or right 112*b* media width adjuster is moved in an inward direction 114 toward the center of the tray 102 or an outward direction 116 toward the edge of the tray 102, the other media width adjuster 112 also moves inward 114 or outward 116 in a corresponding manner. This corresponding movement of the left and right media width adjusters serves to align paper in the center of the tray 102.

Figure 3:
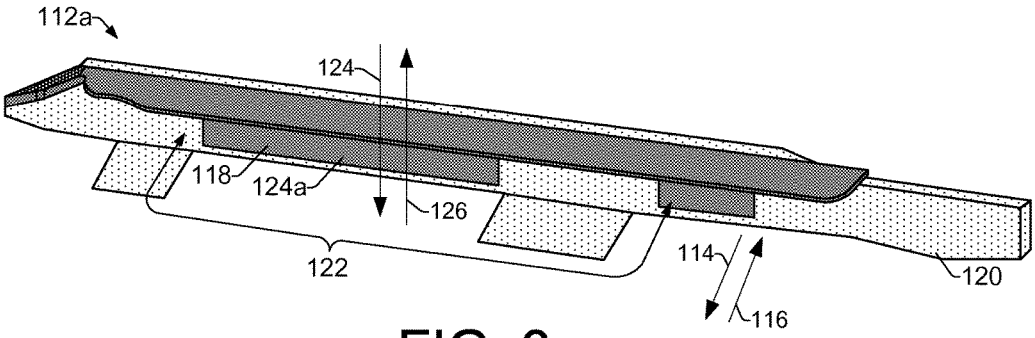
FIG. 3 shows a perspective view of an example of a single media width adjuster that is consistent with the example media width adjuster shown in FIGS. 1 and 2.

FIG. 3 shows a perspective view of a single media width adjuster 112 that is consistent with the left media width adjuster 112*a* shown in FIGS. 1 and 2. As shown in FIG. 3, media width adjusters 112 have a top portion 118 and a bottom portion 120 that fit together to form a wall 122. Thus, the wall 122 of a media width adjuster 112 comprises sections from both the top portion 118 and the bottom portion 120 of the media width adjuster 112. As the media width adjusters 112 move from left to right (i.e., inward 114 and outward 116) within the first media tray 102, the walls 122 of the media width adjusters 112 push against and align the media in the tray 102. In addition to moving left and right within the tray 102 to align the media, the wall 122 increases in height when the second media tray 104 is removed from the first media tray 102. The top portion 118 of the media width adjusters 112 can move vertically (i.e., up 126 and down 124) to accommodate additional amounts of media within the first media tray 102 when the second media tray 104 is removed from the first media tray 102. More specifically, the top portion 118 of the media width adjusters 112 can move from a first stable position 124*a* (FIG. 3) when the second media tray 104 is in the first media tray 102, to a second stable position 126*a* (FIG. 4) when the second media tray 104 is removed from the first media tray 102. The top portion 118 of the media width adjuster 112*a* shown in FIG. 3 is in a first stable position 124*a*. In this example, the first stable position 124*a* is when the top portion 118 of the media width adjuster 112*a* is down 124.

Figure 4:
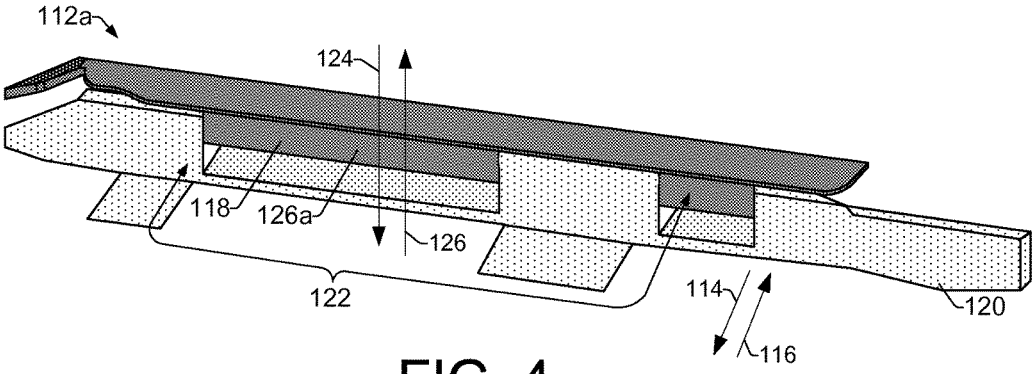
FIG. 4 shows a perspective view of an example of a single media width adjuster as in FIG. 3, where the top portion of the media width adjuster is in a second stable position.

FIG. 4 shows a perspective view of a single media width adjuster 112*a* as in FIG. 3, where the top portion 118 of the media width adjuster 112*a* is in a second stable position 126*a*. In this example, the top portion 118 of the media width adjuster 112*a* is in the second stable position 126*a* when it is in the up 126 position. The top portion 118 moves to the second stable position 126*a* when the second media tray 104 is removed from the first media tray 102, as discussed in greater detail below with reference to FIGS. 5-8. When the top portions 118 of the media width adjusters 112 are up 126, there is additional room to stack media into the first media tray 102. As shown in FIG. 4, when the top portion 118 of a media width adjuster 112 is raised to the up 126 position (i.e., second stable position 126*a*), the sections of the wall 122 that are part of the top portion 118 are heightened or extended upward to accommodate for the height of the additional media that may be stacked into the tray 102. The sections of the wall 122 that are part of the top portion 118 of the media width adjuster 112 move up 126 and down 124.

Heightening the wall 122 in this manner ensures that the wall 122 can properly guide and align the additional amount of medal added within the tray 102 as the media width adjusters 112 are moved in an inward direction 114 toward the center of the tray 102 or an outward direction 116 toward the edge of the tray 102. Components that function to raise and lower the top portion 118 of the media width adjusters 112 to heighten the walls 122 are discussed in greater detail below with regard to FIGS. 5-8.

Figure 5:
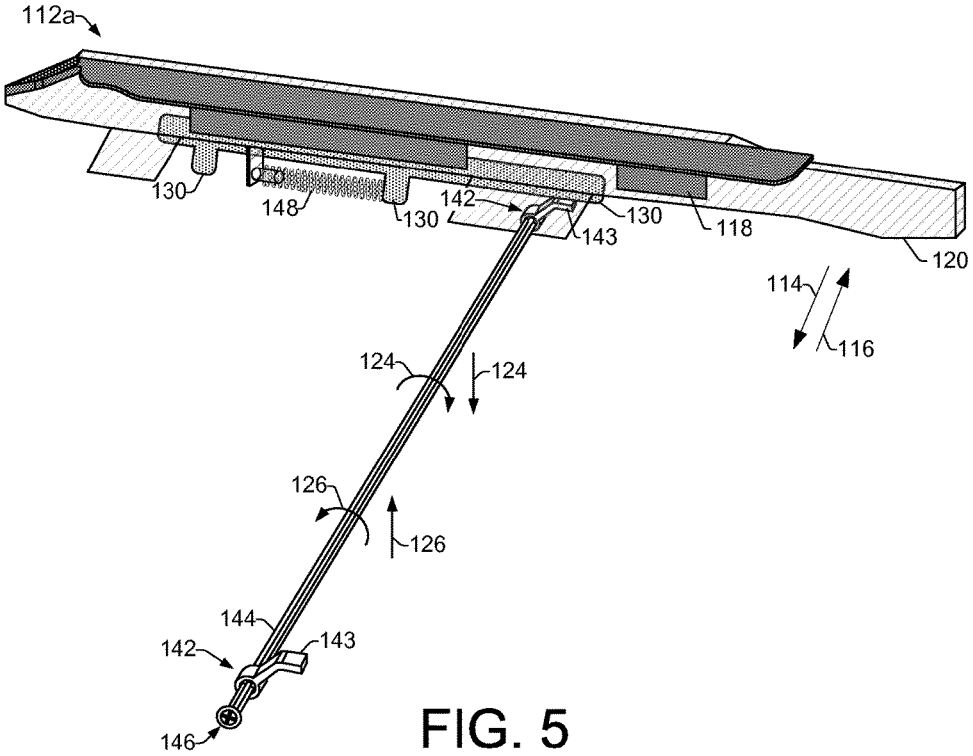
FIG. 5 shows a perspective view of an example of the single media width adjuster as shown in FIG. 3 with components of a wall heightening mechanism that operates to heighten the walls of the media width adjuster.
Figure 6:
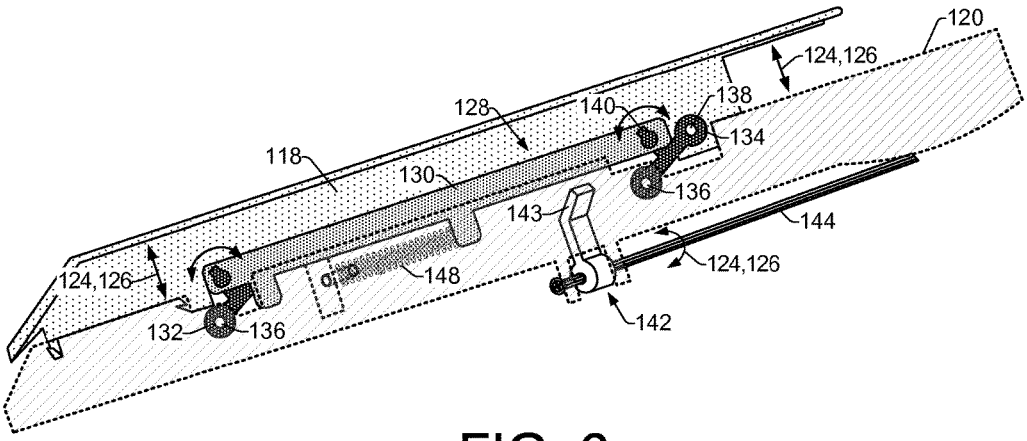
FIG. 6 shows a different perspective view of an example of the single media width adjuster as shown in FIG. 3 with components of a wall heightening mechanism that operates to heighten the walls of the media width adjuster.

FIGS. 5 and 6 show different perspective views of the single media width adjuster 112*a* as shown in FIG. 3, along with components of a wall heightening mechanism that operates to heighten the walls of the media width adjusters. In general, components of the wall heightening mechanism operate to raise and lower the top portion 118 of the media width adjuster 112 between a first stable position 124*a* and a second stable position 126*a*. In the example shown in FIGS. 5 and 6, the bottom portion 120 of the media width adjuster 112 is shown as being partially transparent in order to better illustrate components of the wall heightening mechanism.

Referring now primarily to FIGS. 5 and 6, components of a wall heightening mechanism include a uniform motion mechanism 128 to elevate and lower the top portion 118 of the media width adjuster 112 evenly between the first stable position 124*a* and the second stable position 126*a*. In this example, the uniform motion mechanism 128 comprises a four-bar linkage 128. However, uniform motion mechanisms other than a four-bar linkage are possible and are contemplated herein. Other uniform motion mechanisms can include, for example, a scissor lift mechanism. The four-bar linkage 128 includes a coupler link 130 and two linkage arms 132 and 134, that are each rotatably coupled at a first axis 136*a* and 136*b*, respectively, to the bottom portion 120, at a second axis 138*a* and 138*b*, respectively, to the top portion 118, and at a third axis 140*a* and 140*b*, respectively, to the coupler link 130. As one end of the coupler link 130 is moved up or down, the rotation of the linkage arms 132 and 134 around respective axes 136*a* and 136*b*, 138*a* and 138*b*, and 140*a* and 140*b*, causes the other end of the coupler link 130 to move in the same way. Thus, the four-bar linkage 128 provides a level motion upward and downward that elevates and lowers the top portion 118 of the media width adjuster 112 evenly between the first 124*a* and second 126*a* stable positions.

A cam 142, also shown in FIGS. 5 and 6, is another component of the wall heightening mechanism. The cam 142 is rotatably and slidably coupled to a shaft 144 positioned on the underside of the first media tray 102 (see also FIGS. 1 and 2). As the cam 142 rotates, the cam arm 143 engages the four-bar linkage 128 (i.e., uniform motion mechanism 128) and moves the four-bar linkage 128 up and down. The cam 142 is rotatably affixed to the shaft 144 by the circumferential shape of the shaft 144. That is, the shape of the shaft 144 matches the shape of the center hole in the cam 142 about which the cam arm 143 is to rotate. In the illustrated examples, the shaft 144 has a cross shape 146 that fits into the corresponding cross shape of the center hole of the cam 142 to drive rotation of the cam 142. However, other shapes for the shaft 144 are possible and are contemplated that may be equally as effective in driving rotation of the cam 142. Other shaft shapes may include, for example, triangular, rectangular, star, square, hexagonal, double-square, triple-square, notched, and so on. Thus, with the shaped-shaft 144 inserted into the correspondingly shaped cam 142, rotation of the shaped-shaft 144 results in a corresponding rotation of the cam arm 143. As the cam arm 143 rotates upward, it contacts the uniform motion mechanism 128 and pushes it upward, which in turn elevates the top portion 118 of the media width adjuster 112 evenly from the first stable position 124*a* to the second stable position 126*a*. Two cams 142 are slidably coupled to the shaft 144 so that they are able to slide along the shaft 144 as the media width adjusters 112 are moved in an inward direction 114 toward the center of the tray 102 or an outward direction 116 toward the edge of the tray 102.

Another component of the wall heightening mechanism shown in FIGS. 5 and 6, is a tension spring 148. Both media width adjusters 112 include a tension spring 148 coupled between the bottom portion 120 of the media width adjusters 112 and the coupler link 130 of the four-bar linkage 128 (i.e., the uniform motion mechanism 128). The tension spring 148 applies tension to the uniform motion mechanism 128 to drive the top portion 118 of the media width adjuster 112 between first and second stable positions. When the top portion 118 is in a first stable position 124*a* (i.e., down 124), the tension from the tension spring 148 exerts a force that tends to hold the top portion 118 in the first stable position 124*a*. When the cam arm 143 rotates to push the coupler link 130 of the four-bar linkage 128 (uniform motion mechanism 128) upward, the top portion 118 of the media width adjuster 112 travels in an arced path according to the rotation of the two linkage arms 132 and 134. As the top portion 118 travels past the mid-point of the arced path, the force from the tension spring 148 tends to pull the top portion 118 into the second stable position 126*a* (i.e., up 126).

Figure 7:
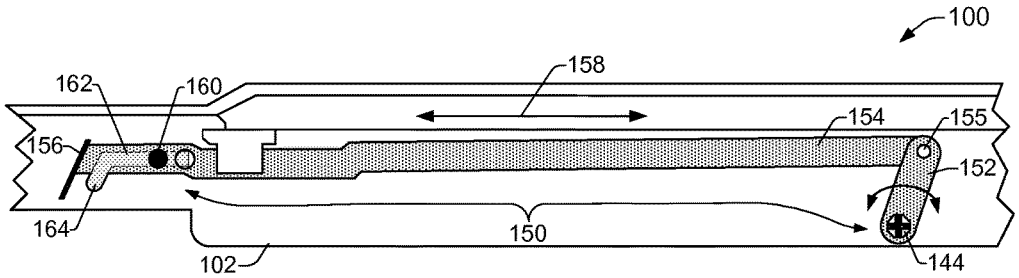
FIG. 7 shows a side view of the example media tray assembly from FIG. 1, illustrating an example linkage assembly.
Figure 8:
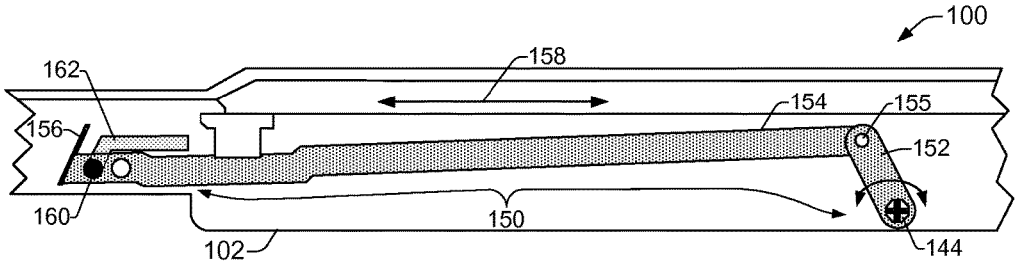
FIG. 8 shows another side view of the example media tray assembly from FIG. 1, illustrating an example linkage assembly.

FIGS. 7 and 8 show a side view of the example media tray assembly 100 from FIG. 1, illustrating an example linkage assembly 150. The linkage assembly 150 is another component of the wall heightening mechanism that operates to raise and lower the top portion 118 of the media width adjuster 112 between a first stable position 124*a* and a second stable position 126*a*. As shown in FIGS. 7 and 8, the linkage assembly 150 includes a short first link 152 that is rotatably coupled at a first end to the cross-shaped shaft 144. The first link 152 and the shaft 144 can be rotatably coupled in a manner similar to that of the cam 142 and the shaft 144 as discussed above. That is, the first link 152 receives the cross-shaped shaft 144 through a corresponding cross-shaped opening around which the link 152 can rotate. When the first link 152 rotates, it causes the cross-shaped shaft 144 to rotate. A longer second link 154 is hinged 155 at one end to the second end of the first link 152. Movement of the second link 154 causes the first link 152 to rotate the shaft 144. The second end of the second link 154 is confined within a slot 156 at the side of the first media tray 102 so that movement of the second link 154 is generally in a horizontal direction 158 with respect to the tray 102, as shown by the direction arrow 158.

The linkage assembly 150 is activated to rotate the shaft 144 when the second media tray 102 (FIGS. 1 and 2) is removed from the first media tray 102. Referring to FIGS. 7 and 8, as the second media tray 102 is removed, it engages a slidable pin 160, and the slidable pin 160 engages a hole within the second link 154 of the linkage assembly 150. As the second media tray 102 is being removed, it slides the pin 160 within a pin slot 162 and pulls the second link 154 toward the left as shown in FIGS. 7 and 8. When the pin 160 drops down into a dog leg 164 along the pin slot 162, the pin 160 disengages from the second media tray 102 so the second media tray 102 can be removed.

As the pin 160 pulls the second link 154 toward the left as shown in FIGS. 7 and 8, the first link 152 of the linkage assembly 150 rotates, which in turn rotates the cross-shaped shaft 144. As discussed above with regard to FIGS. 5 and 6, rotation of the shaft 144 results in a corresponding rotation of the cam 142 and cam arm 143. As the cam arm 143 rotates upward, it contacts the uniform motion mechanism 128 and pushes it upward, which in turn elevates the top portion 118 of the media width adjuster 112 evenly from the first stable position 124*a* to the second stable position 126*a*. Elevation of the top portion 118 heightens the walls 122 of the media width adjuster 112, enabling additional paper to be stacked into the first media tray 102 in the absence of the second media tray 102.

What is claimed is:

1. A media tray assembly for use in an imaging device, the media tray assembly comprising:

a media width adjuster having height-extendable walls with a bottom portion and a top portion, the top portion extendable between first and second stable positions relative to the bottom portion; and a tension spring to drive the top portion to the stable positions.

2. A media tray assembly as in claim 1, further comprising a uniform motion mechanism to elevate and lower the top portion evenly between the stable positions.

3. A media tray assembly as in claim 2, wherein the uniform motion mechanism comprises a four-bar linkage, the four-bar linkage comprising:

a coupler link; and two arms that are each rotatably coupled at a first axis to the bottom portion, at a second axis to the top portion, and at a third axis to the coupler link.

4. A media tray assembly as in claim 3, further comprising:

a first media tray;

a shaft positioned underneath and across a width of the first media tray; and a cam slidably and rotatably coupled to the shaft to rotate with the shaft and engage the coupler link.

5. A media tray assembly as in claim 4, further comprising:

a linkage assembly to cause the shaft to rotate upon removal of a second media tray from the first media tray.

6. A media tray assembly as in claim 5, wherein the linkage assembly comprises:

a first link rotatably coupled at a first end to the shaft;

a second link hinged at one end to a second end of the first link; and a pin to engage another end of the second link and, upon removal of the second media tray, to pull the second link and cause the first link to rotate the shaft.

7. A media tray assembly comprising:

a first media tray having two media width adjusters with walls to align media, each media width adjuster comprises a top portion and a bottom portion;

a second media tray positioned in the first media tray; and a wall heightening mechanism comprising:

a uniform motion mechanism to elevate and lower each top portion between a first stable position and a second stable position; and a cam to rotate on a shaft and to engage the uniform motion mechanism to elevate each top portion to the second stable position as the second media tray is removed from the first media tray to increase height of the walls.

8. A media tray assembly as in claim 7, wherein the wall heightening mechanism comprises a linkage assembly to rotate the shaft upon removal of the second media tray from the first media tray.

9. A media tray assembly as in claim 7, wherein the wall heightening mechanism comprises:

a tension spring coupled between the bottom portion and the uniform motion mechanism, the tension spring to apply tension to the uniform motion mechanism to drive the top portion between the first and second stable positions.

10. A media tray assembly as in claim 7, wherein the uniform motion mechanism comprises a four-bar linkage.

11. A media tray assembly as in claim 10, wherein the four-bar linkage comprises:

a coupler link; and two linkage arms each rotatably coupled at a first axis to the bottom portion, at a second axis to the top portion, and at a third axis to the coupler link.

12. A media tray assembly comprising:

a first media tray;

a second media tray insertable into and removable from the first media tray;

media width adjusters to align media within the first media tray, the media width adjusters comprising height-extendable walls; and a uniform motion mechanism comprising a four-bar linkage to extend the height-extendable walls upon removal of the second media tray.

* * * * *